US005157873A

United States Patent [19]

Rudolf et al.

[11] Patent Number: 5,157,873

[45] Date of Patent: Oct. 27, 1992

[54] PORTABLE GRINDER WITH QUICK-ACTING CHUCKING DEVICE

[75] Inventors: Boris Rudolf, Stuttgart; Walter Blutharsch, Sindelfingen, both of Fed. Rep. of Germany

[73] Assignee: C. & E. Fein GmbH & Co., Fed. Rep. of Germany

[21] Appl. No.: 819,092

[22] Filed: Jan. 9, 1992

[30] Foreign Application Priority Data

Jan. 16, 1991 [DE] Fed. Rep. of Germany ..... 4101113
Feb. 6, 1991 [DE] Fed. Rep. of Germany ..... 4103501
Jun. 26, 1991 [DE] Fed. Rep. of Germany ..... 9107823

[51] Int. Cl.[5] ..... B24B 23/02; B24B 45/00

[52] U.S. Cl. ..... 51/168; 51/377; 403/349; 83/666; 83/698; 279/904

[58] Field of Search ..... 51/170 R, 170 T, 170 PT, 51/376, 377, 358, 168, 209 R; 403/349, 348, 345; 83/666, 698; 279/904

[56] References Cited

U.S. PATENT DOCUMENTS 2,611,621 9/1952 Patterson et al. ..... 279/904
2,789,402 4/1957 Tocci-Guilbert .
3,691,900 9/1972 Novak et al. ..... 51/168
3,912,411 10/1975 Moffat ..... 51/168
4,497,141 2/1985 Jarby ..... 51/168
4,989,374 2/1991 Rudolf et al. ..... 51/168
5,058,909 10/1991 Rudolf et al. ..... 51/168

FOREIGN PATENT DOCUMENTS 0152564 8/1985 European Pat. Off. ..... 51/170 T
1577595 1/1970 Fed. Rep. of Germany .

*Primary Examiner*—Roscoe V. Parker
*Attorney, Agent, or Firm*—Barry R. Lipsitz

[57] ABSTRACT

A portable grinder (10) has a motor-driven drive shaft (15) and a quick-acting chucking device for a grinding tool (43), which comprises a spindle (20), coaxial with the drive shaft (15), which is braced against the drive shaft (15) by a spring (24) in the axial direction and can be displaced in the axial direction relative to the drive shaft (15) by means of a clamping lever (32). One external free end of the spindle (20) retains the grinding tool (43), which in a released position—with the free end of the spindle (20) extended and the spring (24) tensioned—can be removed from the free end, and in a tightened position—with the free end of the spindle (20) retracted and the spring (24) partly relaxed—is non-rotatably joined to the drive shaft. The free end is configured as a bayonet end (40) which extends though the grinding tool (43). An attachment collet (41) with a bayonet opening can be placed from outside onto the bayonet end (40).

16 Claims, 5 Drawing Sheets

Fig. 2
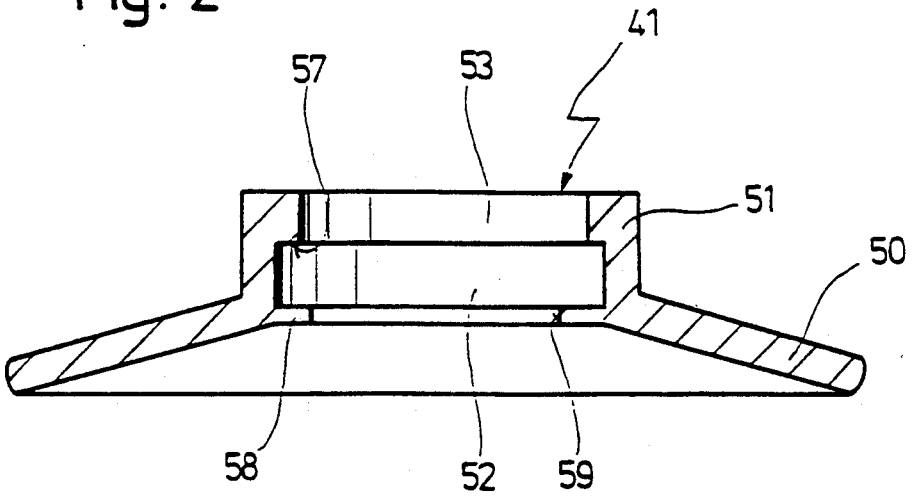
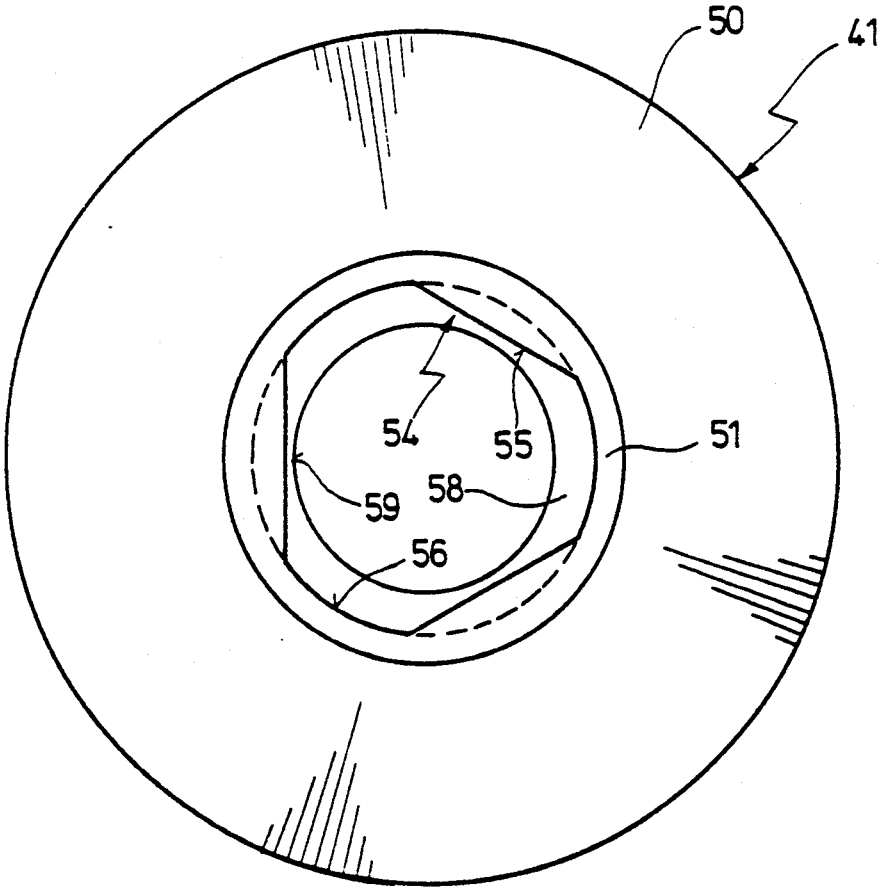
Fig. 3

PORTABLE GRINDER WITH QUICK-ACTING CHUCKING DEVICE

The invention relates to a portable grinder with a motor-driven drive shaft and a quick-acting chucking device for a grinding tool, in which the quick-acting chucking device comprises a spindle, coaxial with the drive shaft, which is braced against the drive shaft by a spring in the axial direction and can be displaced in the axial direction relative to the drive shaft by means of a clamping lever, with one external free end of the spindle retaining the grinding tool, which in a released position—with the free end of the spindle extended and the spring tensioned—can be removed from the free end, and in a tightened position—with the free end of the spindle retracted and the spring partly relaxed—is non-rotatably joined to the drive shaft.

A grinder of the type described above is known from EP-OS 152 564.

The known grinder is a right-angle grinder and the grinding tool is a rigid grinding wheel. In the released position, the free end of the spindle projects out from the grinder housing, and the grinding wheel can be threaded onto the free end of the spindle. In one embodiment of the known grinder, this is achieved by the fact that the projecting free end of the spindle is equipped with a threaded segment that extends through the grinding wheel, onto which a fastening nut can be threaded from outside, covering the central region of the grinding wheel. In another exemplary embodiment of the known grinder, the projecting end of the spindle is provided with a central hole, at the bottom of which is an element similar to a collet chuck with an internal threaded bore. A stud, whose thickened end covers the central region of the grinding wheel, can be inserted from outside through a central opening in the grinding wheel, and introduced into the central opening of the grinding wheel. The stud has at its inner free end a threaded segment that engages in the element similar to a collet chuck. In a third exemplary embodiment of the known grinder, an arrangement similar to the exemplary embodiment discussed previously is used, in which once again a stud is threaded into a central hole in the drive spindle. In this case, however, an attachment collet is also located between the thickened outer end of the stud and the grinding wheel.

The aforesaid embodiments of the known grinder therefore share the characteristic that in the released position, with the free end of the drive spindle extended, an element (nut or stud) must be screwed on from outside in order to fasten the grinding tool, in the form of a rigid grinding wheel, onto the drive spindle. When the tightened position is then assumed by actuating the clamping lever, the drive spindle, with the grinding tool fastened onto it, is retracted, and the grinding tool is in frictionally engaged contact with the drive shaft under the force of the only partly relaxed spring.

It has now been found in practice that the known grinder is somewhat awkward to use in certain applications. This is especially the case when the grinding tool used is a flexible grinding disk that has an internally tapered contact surface for an abrasive paper, which extends peripherally into a contact surface that is flat in the rest position.

In grinding tools of this type, the abrasive paper is pressed in its central region into the internally tapered contact surface when it is attached. In this situation, threading in a nut or a stud can be difficult, especially when a relatively thick abrasive paper is used, for example as is ordinarily used for roughing. In such an application it may also happen that an undefined threading-in depth occurs when a nut or stud is threaded in, so that when the quick-acting chucking device is tightened, there is (at least at first) no secure frictional engagement between the grinding tool and the drive shaft. Although this frictional engagement does automatically occur with the known grinder because the grinding tool tightens itself up, this is nevertheless not desirable in all applications, since well-defined, secure clamping conditions are desired right from the start.

The object on which the invention is based is therefore that of developing a grinder of the type mentioned above in such a way that the procedure for fastening the grinding tool is simplified.

This object is achieved, according to the invention, in a grinder of the type mentioned above, by the fact that the free end is configured as a bayonet end which extends though the grinding tool; and that an attachment collet with a bayonet opening can be placed from outside onto the bayonet end, with the attachment collet covering the grinding tool from outside.

It is thus possible, with a single motion, to fasten the attachment collet onto the free end of the spindle by means of the bayonet arrangement. All that is necessary in order to fasten the grinding tool is to place the attachment collet with the bayonet opening on the bayonet end and twist. Because of the fact that bayonet arrangements can be correctly tightened in only one axial position, there is also a defined tightening travel for the grinding tool, so that given suitable dimensioning of the quick-acting chucking device and of the displacement travel of the drive spindle, the grinding tool is securely tightened from the start, i.e. is retained with full frictional engagement.

Alternatively, the object is achieved by the fact that in a grinder of the type mentioned above, the grinding tool is configured as a brush tool on which an attachment collet with a bayonet opening is provided; and that the free end of the spindle is configured as a bayonet end, onto which the grinding tool with the bayonet opening can be placed.

It is thus possible to fasten a brush-type grinding tool, in the manner described above, onto the free end of the spindle with a single motion. This can be done without the aid of an adapter. A further advantage is the fact that, in contrast to conventional brush tools, attachment occurs without a central screw mount. Specifically, because brush tools are often in the form of narrow cups, a screw is difficult to reach in the cavity of conventional brush tools. Also, in the event of a slip, there is the danger of injury on the sharp brush of the grinding tool. With the solution according to the invention the risk of injury is greatly reduced, since the grinding tool can be grasped from outside, and manipulation in the center of the brush-type tool is no longer necessary.

In a preferred embodiment of the grinder according to the invention, the disk-shaped grinding tool comprises a flexible grinding disk that has an inner region with an internally tapered contact surface for an abrasive paper, with the attachment collet comprising an externally tapered segment for pressing the abrasive paper against the internally tapered contact surface.

This feature has the advantage that simple, reliable fastening of the abrasive paper to the flexible grinding disk is possible with such flexible grinding tools, without the disadvantages of the prior art mentioned earlier.

It is preferable, in this exemplary embodiment, if the axial length of the spring is a multiple, preferably three to 10 times, of the axial height of the internally tapered contact surface.

This feature has the advantage of permitting reliable clamping of the abrasive paper onto the flexible grinding disk with a longitudinal stroke clamping device of this type.

This is especially the case when the displacement travel of the spindle between the released and tightened settings, which can be adjusted by means of the clamping lever, is at least as great as the axial height of the internally tapered contact surface.

This feature has the advantage that even when abrasive paper is only laid loosely on the flexible grinding disk, it is reliably clamped with frictional engagement.

A further and especially preferred exemplary embodiment of the invention is characterized by the fact that the bayonet end has a first outer bayonet segment of greater cross-sectional area, and a second inner bayonet segment of smaller cross-sectional area; that the cross-sectional shape of the first bayonet segment is that of a regular trihedron with three straight lines and three arc-shaped segments; that the cross-sectional shape of the second bayonet segment comprises three arc-shaped segments with the radius of the inscribed circle of the trihedron and a circumferential angle of 60°, three first straight segments, which are aligned with the straight segments of the trihedron and have half their width, and three second straight segments that connect to the first straight segments at 120° and have the same width as them; and that the bayonet opening of the attachment collet has a cross-sectional shape that essentially conforms to that of the first bayonet segment.

This feature has the advantage of resulting in a bayonet mount that is of simple configuration and is therefore reliable in long-term operation, especially in terms of the harsh utilization conditions of grinders, for example right-angle grinders. Moreover, the aforesaid configuration has the advantage that the attachment collet can be fastened to the bayonet end by simply sliding it on and twisting, without having to displace the attachment collet by an additional amount axially outward, as is the case with many bayonet sockets.

In a particularly preferred development of the invention, the bayonet end seats against the bayonet opening without pitch, by means of radial end surfaces.

This feature has the advantage that the design and therefore the manufacture of the bayonet is simplified, since the bayonet opening of the attachment collet merely needs to be rotated circumferentially with respect to the bayonet end of the free end of the spindle, but does not need to be threaded onto it. This is particularly successful in the exemplary embodiment mentioned earlier, in which a wedging effect occurs in the circumferential direction of the bayonet connection, by means of which the attachment collet is mounted onto the bayonet end of the spindle without having to be threaded on.

In a further preferred exemplary embodiment of the invention, the bayonet end at the free end of the spindle is provided with an extension which, when the bayonet connection is closed, engages positively in an external opening of the bayonet collet.

This feature has the advantage that the positively acting elements of the bayonet connection are protected against contamination, since the extension in the outer opening constitutes a seal for the internal elements of the bayonet connection with respect to the outside world.

In a further preferred embodiment of the invention, the grinding tool has bristles that are retained between an outer cup-shaped bristle receptacle and an inner cup-shaped bristle receptacle.

This allows for simple and secure mounting of the bristles.

In a further preferred embodiment of the invention, the outer bristle receptacle is welded to the attachment collet.

This has the advantage that the same attachment collet as in the embodiment described previously can be used for a disk-shaped grinding tool.

In a further embodiment of the invention, there is arranged between the inner bristle receptacle and the outer bristle receptacle, in order to fasten the bristles, a disk washer on the periphery of which are holes extending axially, through which the individual bristles are guided in loops.

This embodiment guarantees that the bristles are fastened in a particularly secure and durable manner.

In a further advantageous embodiment of the invention, the bristle receptacles and the disk washer are retained on a cylindrical support element, and fastened between a collar and a circumferential edge bead of the support element.

This guarantees particularly simple assembly. First the bristle receptacles are pushed, together with the bristles fastened onto the disk washer, onto the cylindrical support element, which is then crimped from the outside to produce the circumferential edge bead, guaranteeing that the arrangement is held securely on the support element.

Further advantages are apparent from the description and the attached drawings.

It is understood that the features mentioned above and yet to be explained below may be used, not only in the particular combination indicated, but also in other combinations or in isolation, without leaving the context of the present invention.

An exemplary embodiment of the invention is depicted in the drawings, and will be explained in more detail in the description which follows. In the drawings:

FIG. 2 is an axial section, greatly enlarged, through an attachment collet as used in the grinder according to FIG. 1;

FIG. 3 is a top view of the attachment collet depicted in FIG. 2;

Figure 1:
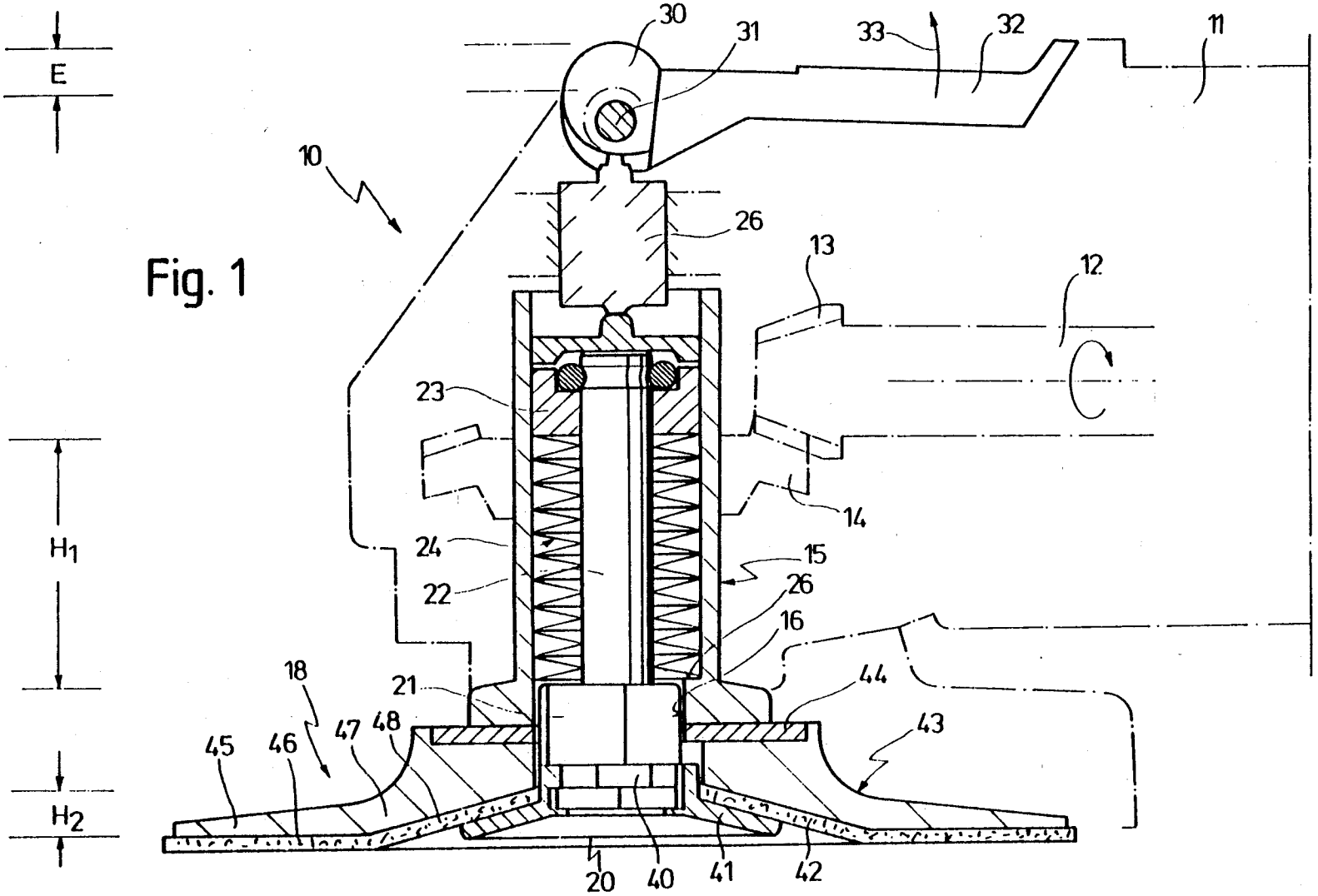
FIG. 1 is a side view, in section and in some cases highly schematized, through a front end of an exemplary embodiment of a grinder according to the invention, in the form of a right-angle grinder.

In FIG. 1, 10 refers to the entirety of a right-angle grinder of known conventional design. The right-angle grinder 10 has a housing 11 in which a motor shaft 12 is mounted. The motor shaft 12 is driven by a motor (not depicted), for example an electric motor, a pneumatic motor, or the like, as indicated by an arrow. Arranged non-rotatably on the free end of the motor shaft 12, on the left in FIG. 1, is a tapered first pinion 13. The first pinion 13 meshes with a second pinion 14, which is also tapered, resulting in a right-angle drive.

The second pinion 14 is non-rotatably attached to a hollow drive shaft 15. The drive shaft 15 has at its lower free end an eccentric internal profile 16.

A drive spindle 20 is arranged concentrically with the drive shaft 15 and inside it. An eccentric segment 21 of the spindle 20 is matched to the eccentric internal profile 16 of the drive shaft 15, so that the spindle 20 is arranged non-rotatably, but in an axially displaceable manner, in the drive shaft 15.

The spindle 20 is configured, at its end shown at the top in FIG. 1, as an extended stud 22. The stud 22 has at its upper free end a stop 23. A disk spring stack 24 occupies a gap between the stud 22 and the drive shaft 15. The disk spring stack 24 is braced at the top against the stop 23 and at the bottom against a shoulder 25 of the drive shaft 15.

The spindle 20 with the stop 23 is connected axially, by means of an axially movable pressure element 26, to a cam 30. The cam 30 can rotate about a shaft 31 extending perpendicular to the drawing plane of FIG. 1. For this purpose, it is provided with an extended lever 32 which can pivot in the drawing plane of FIG. 1, as indicated by an arrow 33.

The drive shaft 15 is mounted axially and rigidly in the housing 11 in a manner not depicted in greater detail. The shoulder is therefore fixed in position with respect to the housing 11.

FIG. 1 depicts a tightened position in which the disk spring stack 24 forces the stop 23 upward, with the result that the spindle 20 is retracted into the housing 11. This is possible because the cam 30 is in a position in which the pressure element 26 is at a minimum distance from the shaft 31.

On the other hand, when the lever 32 is pivoted upward in the direction of the arrow 33, the pressure element 26 is pressed downward because the cam 30 becomes wider. Because of this the stop 23 is also axially displaced downward, with the result that the disk spring stack 24 is compressed. At the end of the pivot travel of the lever 32, the spindle 20 is at its lower end position, which serves as the released position as will be explained later.

In the released position, a lower end of the spindle 20 which is configured as a bayonet end 40 projects to its maximum extent out of the drive shaft 15.

The arrangement is designed so that an attachment collet 41 can be placed and fastened onto the bayonet end 40. The attachment collet 41, the details of which are depicted in FIGS. 2 and 3, covers the central region of an abrasive paper 42 from the outside, and presses it against a flexible grinding disk 43. The grinding disk 43 is provided, on its side facing the housing 11, with a rigid plate 44 which contacts from the outside a radial end surface of the drive shaft 15.

The flexible grinding disk 43 has an outer region 45 with an outer flat contact surface 46, as well as an inner region 47 with an inner, internally tapered contact surface 48.

Similarly, the attachment collet 41, as clearly depicted in FIGS. 2 and 3, has a hollow conical segment 50, the angle of which is matched to that of the internally tapered contact surface 48. In the center, the hollow conical segment 50 of the attachment collet 41 merges into a cylindrical segment 51.

The axial section in FIG. 2 shows that the cylindrical segment 51 is divided axially into a lower region 52 and an upper region 53. While the lower region 52 has a cylindrical internal surface, the upper region 53 has a non-circular opening 54, specifically a trihedral profile. The trihedral profile consists of three straight segments 55 and three arc-shaped segments 56.

The upper region 53, which is consequently constricted as compared with the lower region 52 over a portion of the circumference, thus has, in the depiction in FIG. 2, end surfaces 57 on the underside. The end surfaces 57 lie strictly in a radial plane.

Furthermore, extending down from the lower region 52 is a circumferential collar 58, which is provided at its center an opening 59. The opening 59 has, as FIG. 3 clearly shows, a diameter that is smaller than the smallest radius at the three straight segments 55. The opening 59 is preferably configured as a cylindrical opening, but can also be tapered, since in FIG. 2 it is open at the top.

Figure 4:
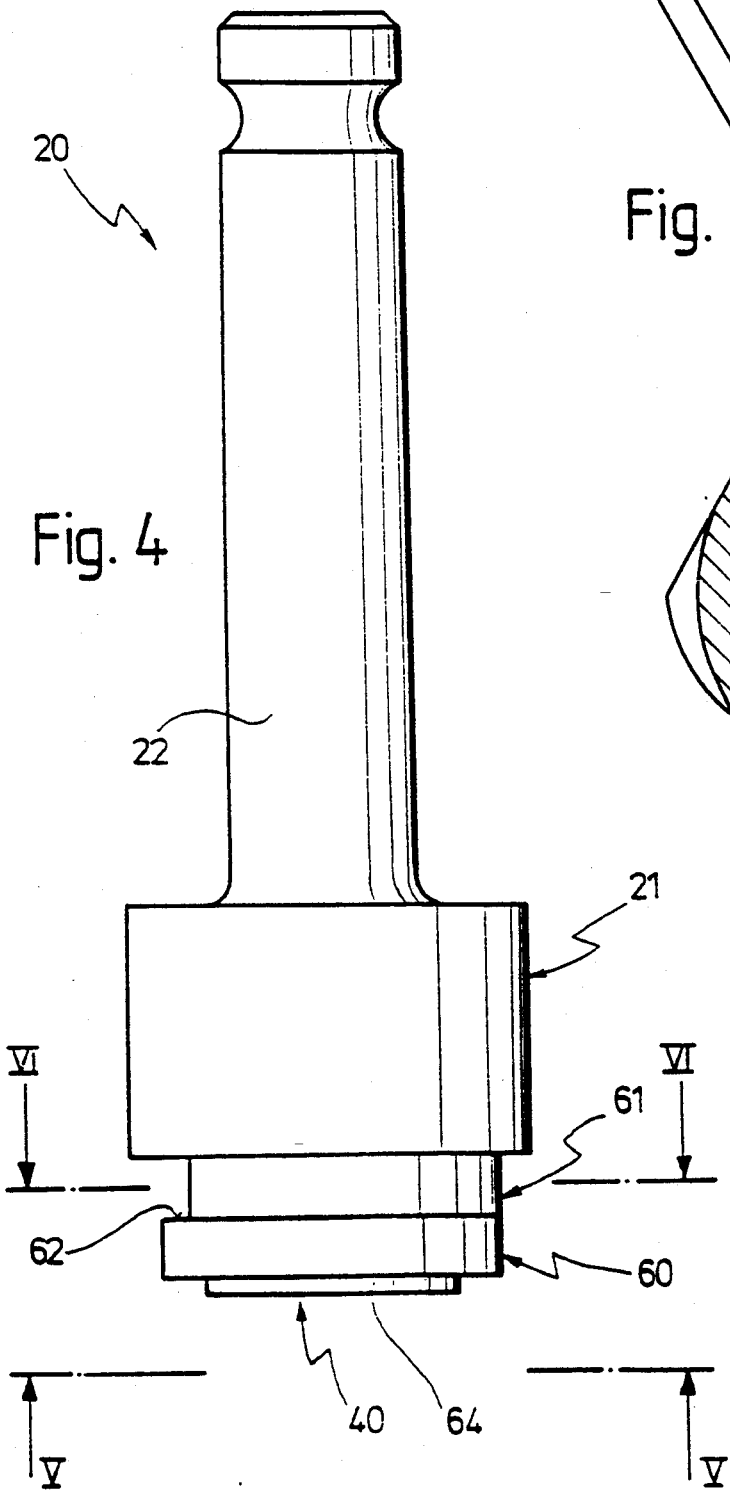
FIG. 4 is a side view, again greatly enlarged, through a drive spindle as used in the grinder according to FIG. 1.
Figure 5:
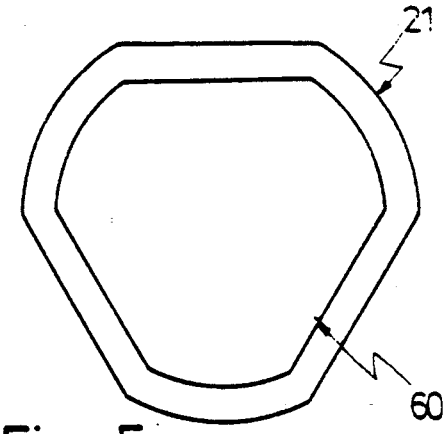
FIG. 5 is a view, from below, of the drive spindle of FIG. 4, in the direction of arrows V—V in FIG. 4.
Figure 6:
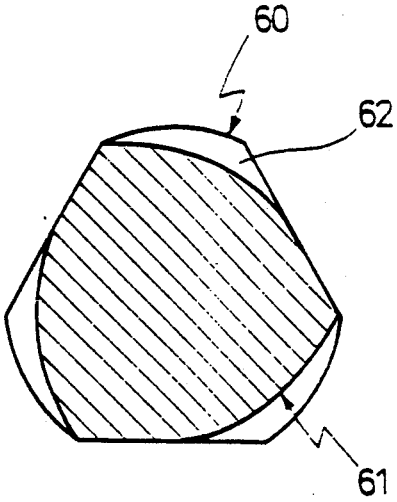
FIG. 6 is a radial section through the drive spindle depicted in FIG. 4, in the direction of arrows VI—VI in FIG. 4.

FIGS. 4 to 6 illustrate that the bayonet end 40 of the spindle 20 is divided into a first lower bayonet segment 60, and a second upper bayonet segment 61. The first bayonet segment 60 has, as is clearly evident from FIG. 6, a greater cross-sectional area than the second bayonet segment 61, resulting in a flat projection 62.

Located at the lower end of the spindle 20, below the first bayonet segment 60, is also an axial extension 64, which is preferably configured as a cylindrical extension. The extension 64 is shaped in such a way that it fits precisely and positively into the opening 59 in the collar 58 of the attachment collet 41.

This ensures that when the bayonet connection is closed, a seal is formed by the extension 64 in the opening 59, preventing dirt from penetrating into regions of the elements forming the bayonet connection which are located behind them.

The cross-sectional shape of the first bayonet segment 60 is identical, except for a slight clearance, to the cross-sectional shape of the opening 54. The axial thickness of the upper region 53 also corresponds essentially to the axial thickness of the second bayonet segment 61.

Because of this, the opening 54 of the attachment collet 41 can be slid over the first bayonet segment 60 and then rotated. The attachment collet 41 is now axially secured in the region of the straight segments 55 of the opening 54 by contact at the projections 62.

Figure 7:
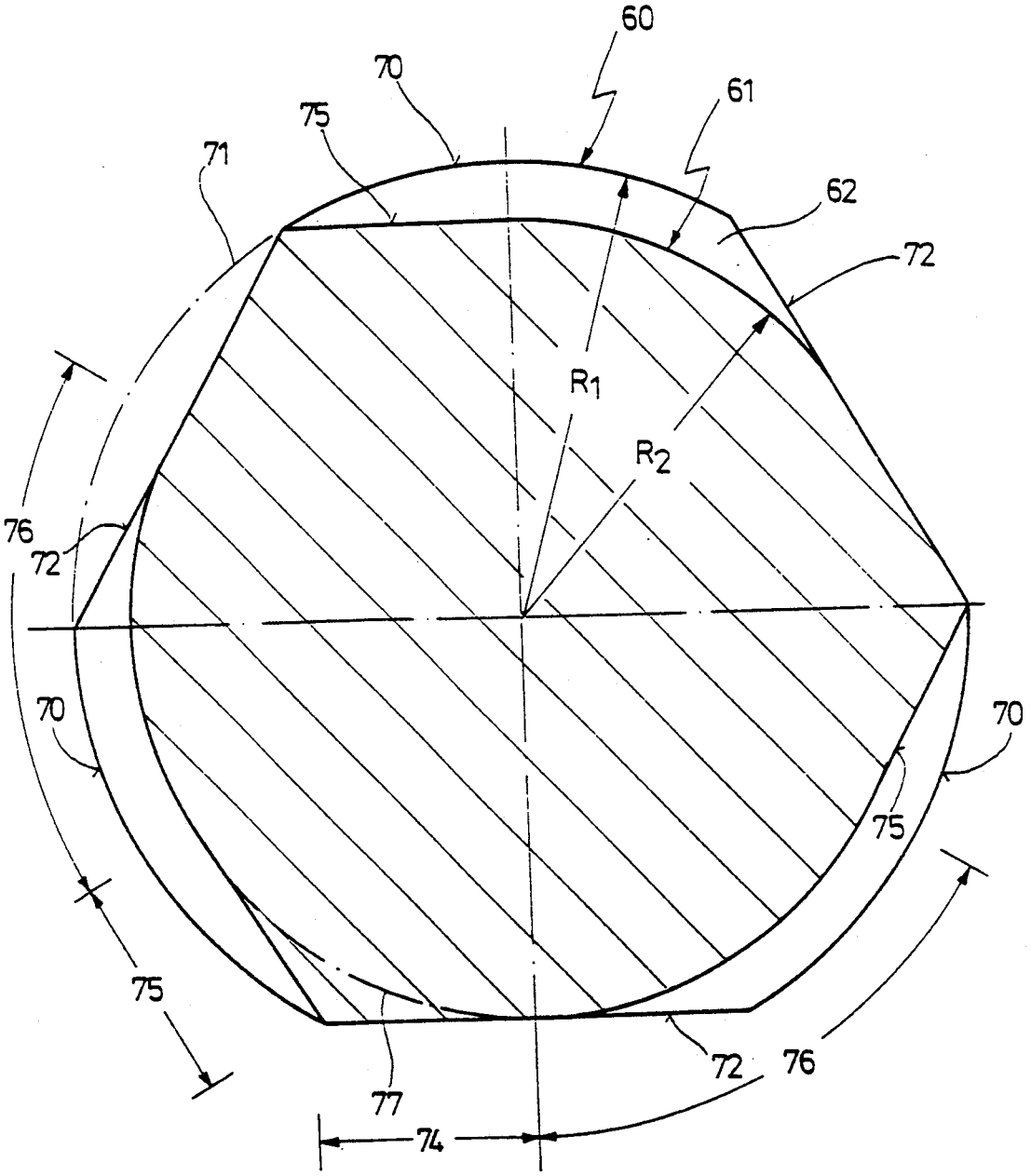
FIG. 7 is a depiction similar to FIG. 6, but further greatly enlarged to explain the geometry of a bayonet connection.

This bayonet connection functions because the second bayonet segment 61 has, with respect to the first bayonet segment 60 and the opening 54 (which is identical thereto in cross-sectional shape), the shape depicted in detail in FIG. 7.

As this Figure shows, the cross-sectional shape of the first bayonet segment 60 is divided into three arc-shaped segments 70 that lie on the same circumscribed circle 71, and three straight segments 72.

The cross-sectional shape of the second bayonet segment 61, however, is divided into three first straight segments 74 and three second straight segments 75, as well as three arc-shaped segments 76 that lie on a circle 77 inscribed within the straight segments 72. The radius of the circumscribed circle 71 is labeled $R_1$, and the radius of the inscribed circle is labeled $R_2$.

The first straight segments 74 align with the straight segments 72 and in each case occupy one-half their width. Continuing from each of the first straight segments 74 at an angle of 120° are the second straight segments 75, whose width corresponds to that of the first straight segments 74. Between them in each case lie the arc-shaped segments 76, which each extend over a circumferential angle of 60°.

Because of this geometry, it is possible to push the opening 54 of the attachment collet 41 over the first bayonet segment 60. In the process, the straight segments 55 of the opening 54 slide axially past the straight segments 72 of the first bayonet segment 60, and therefore also past the first straight segments 74 of the second bayonet segment 61. Since the arc-shaped segments 76 have only the radius $R_2$ of the inscribed circle 77, the attachment collet 41 can now be rotated. The straight segments 55 of the opening 54 then roll along the arc-shaped segments 76 and ultimately come into contact with the second straight segments 75. The rotation travel ends there, since the second straight segments 75 simultaneously constitute a stop in the circumferential direction.

Since the attachment collet 41 is wedged on the lower bayonet end 40 of the spindle 20 in the circumferential direction by relative rotation, further attachment in the axial direction is not necessary. The end surfaces 57 and 62 which contact one another when the bayonet connection is closed can therefore be configured strictly radially, which simplifies manufacture.

In this manner it is possible, with only 60° of rotation, to fasten the attachment collet 41 axially onto the bayonet end 40 of the spindle 20. If the lever 32 is then moved, opposite to the direction of the arrow 33, from the released position back to the tightened position, the attachment collet 41 in FIG. 1 is pulled upward, thus fastening the abrasive paper 42 against the internally tapered contact surface 48 of the flexible grinding disk 43.

For this purpose, the arrangement is configured so that the maximum eccentricity E of the cam 30 is at least as great as the height $H_2$ of the internally tapered contact surface 48. Because of this it is in fact possible, in extreme cases, to indent the initially flat abrasive paper 42 only slightly or not at all in the center when the attachment collet 41 is placed on the bayonet end 40. Specifically, the eccentricity E is sufficient in this instance to cover the entire axial travel corresponding to the height $H_2$.

To achieve this, it is preferable if the axial length $H_1$ of the disk spring stack 24 is considerably greater than the height $H_2$ of the internally tapered contact surface 48. Preferably $H_1$ is three to 30 times, especially 5 times, as great as $H_2$.

It is not a problem if the entire rotation travel of 60° is not completed when the attachment collet 41 is placed on the bayonet end 40, since the arrangement is configured so that the attachment collet 41 tightens itself when the motor is started.

Figure 8:
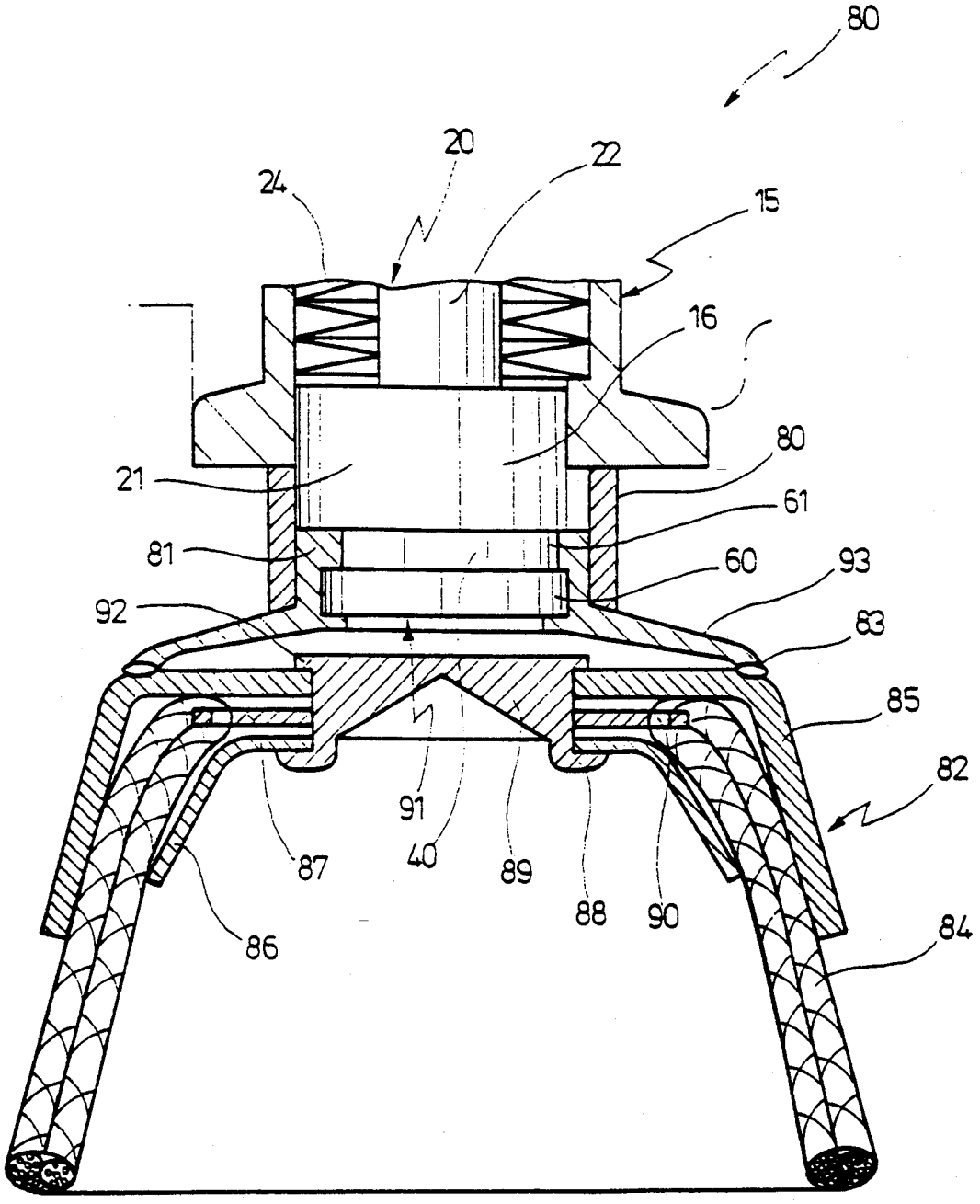
FIG. 8 is an axial section through the outer end of the spindle in an enlarged depiction, on which, in an alternative embodiment, a brush-shaped grinding tool is placed.

A further exemplary embodiment is depicted in FIG. 8.

The right-angle grinder labeled in its entirety with the number 80 corresponds fully, in structure and function, to the right-angle grinder 10 described previously. In place of a disk-shaped grinding tool, this embodiment is provided with a brush-shaped grinding tool, labeled 82 in its entirety. The grinding tool 82 is attached in the manner described earlier to the free end of the spindle 20, which is configured as a bayonet end 40. Here again, a bayonet opening 91, which is provided in an attachment collet 81, can be placed and fastened onto the bayonet end 40.

Since the structure and function of the attachment collet 81 with the bayonet opening 91 are entirely consistent with the embodiment described earlier, further description of the bayonet mount is superfluous at this point. The attachment collet 81 has at its outer end, facing away from the pin 22, a flaring extension 93. This extension 93 is welded at its rim to the cup-shaped brush tool 82 by means of a weld bead 83.

To ensure the necessary clearance between the brush tool 82 and the drive shaft 15, and to prevent outside contamination of the rotating parts, a cylindrical spacer sleeve 80 is pressed onto the attachment collet 41, and projects beyond the attachment collet 41 towards the spindle 20 and contacts the drive shaft 15 at its end.

The grinding tool 82 has bristles 84 that are retained between an outer cup-shaped bristle receptacle 85 and an inner cup-shaped bristle receptacle 86 by means of a disk washer 87. Provided on the periphery of the disk washer 87 are holes 90 extending axially, through which the individual bristles 84 are guided in loops. The bristle receptacles 85 and 86 and the disk washer 87 between them, against which the bristles 84 are held, are attached onto a cylindrical support element 89. The cylindrical support element 89 ends, at its side facing towards the attachment collet 81 in a collar 92 that projects slightly outward, against which the outer bristle receptacle 85 is seated.

During assembly, first the outer bristle receptacle 85 is pushed onto the cylindrical support element 89 until it contacts the collar 92. Then the disk washer 87 with the bristles 84 and the inner bristle receptacle 86 are pushed onto the support element 89. The edges of the support element 89 are then crimped against the inner bristle receptacle 86, creating a circumferential bead 88 by means of which the inner bristle receptacle 86 is held under tension on the support element, so that the bristles 84 are pressed between the two bristle receptacles 85, 86 and project outward.

As already mentioned, the outer bristle receptacle 85 is welded at its edges to the flared extension 93.

The bristles can be arranged so as to produce a braided cup brush. In addition, of course, any other standard embodiments, such as cup brushes, are also possible.

The grinding tool 82 is replaced in the manner described previously with reference to FIGS. 1 to 7.

We claim:

1. A portable grinder including a motor-driven drive shaft and a chucking device for chucking a grinding tool, said chucking device comprising a spindle arranged coaxially with said drive shaft and having an external free end being designed as a bayonet end, a spring for axially bracing said spindle against said drive shaft, a clamping lever for axially displacing said spindle relative to said drive shaft between a released position in which said bayonet end is extended and said spring is tensioned, and between a tightened position in which said bayonet end is retracted and said spring is partly relaxed, a releasable attachment collet having a bayonet opening for attaching said grinding tool by engaging said bayonet end, wherein said grinding tool is removable from said bayonet end with said spindle being in said released position, wherein said grinding tool is joined to the drive shaft non-rotatably with said spindle being in said tightened position.

2. A portable grinder including a motor-driven drive shaft and a chucking device for a brush-shaped grinding tool, said chucking device comprising a spindle arranged coaxially with said drive shaft and having an external free end being designed as a bayonet end, a spring for axially bracing said spindle against said drive shaft, a clamping lever for axially displacing said spindle relative to said drive shaft between a released position in which said bayonet end is extended and said spring is tensioned, and between a tightened position in which said bayonet end is retracted and said spring, is partly relaxed, an attachment collet being arranged on said brush-shaped grinding tool and having a bayonet opening for attaching said brush tool by engaging said bayonet end, wherein said brush-shaped grinding tool is removable from said bayonet end with said spindle being in said released position, wherein said brush-shaped grinding tool is joined to the drive shaft non-rotatably with said spindle being in said tightened position.

3. A grinder according to claim 1, wherein said grinding tool is disk-shaped and comprises a flexible grinding disk having an inner region with an internally tapered contact surface for receiving an abrasive paper, and wherein said attachment collet comprises an externally tapered segment for pressing said abrasive paper against said internally tapered contact surface.

4. A grinder according to claim 3, with said spring having a predetermined axial extension and said internally tapered contact surface having a predetermined axial height, wherein said axial extension of said spring is a multiple, preferably 3 to 10 times, of said axial height of said internally tapered contact surface.

5. A grinder according to claim 4, wherein said spindle travels axially by a certain displacement travel when shifted between said released position and said tightened position by moving said clamping lever, wherein said displacement travel is at least as great as said axial height of said internally tapered contact surface.

6. A grinder according to claim 1, wherein said bayonet end includes a first outer bayonet segment of greater cross-sectional area, and a second inner bayonet segment of smaller cross-sectional area, wherein said first bayonet segment has a cross-sectional shape given by a regular trihedron with three straight and three arc-shaped segments and having an inscribed circle, wherein said second bayonet segment has a cross-sectional shape comprised by three arc-shaped segments having a radius given by said inscribed circle of said trihedron and having a circumferential angle of 60°, three first straight segments, which are aligned with said straight segments of said trihedron and have half their width, and three second straight segments that connect to said first straight segments at 120° and being of the same width as given by the width of said straight segments of said trihedron, and wherein said bayonet opening of said attachment collet has a cross-sectional shape that essentially conforms to said cross-sectional shape of said first bayonet segment.

7. A grinder according to claim 1, wherein said bayonet end contacts said bayonet opening without pitch, by means of radial end surfaces.

8. A grinder according to claim 1, wherein said bayonet end is provided with an extension and said attachment collet is provided with an external opening, and wherein said bayonet end engages positively with said bayonet opening when said bayonet end engages said bayonet opening of said attachment collet.

9. A grinder according to claim 2, wherein said brush-shaped grinding tool includes bristles that are retained between an outer cup-shaped bristle receptacle on said brush-shaped grinding tool and an inner cup-shaped bristle receptacle on said brush-shaped grinding tool.

10. A grinder according to claim 9, wherein said outer bristle receptacle is welded to said attachment collet.

11. A grinder according to claim 9, wherein said brush-shaped grinding tool includes a disk washer being arranged between said inner bristle receptacle and said outer bristle receptacle, said disk washer being provided with holes extending axially, through which said bristles are guided in loops.

12. A grinder according to claim 11, wherein a cylindrical support element is provided on said brush tool for retaining said bristle receptacles and said disk washer coaxially.

13. A grinder according to claim 12, wherein said support element is provided with a collar and a circumferential edge bead for fastening said bristle receptacles and said disk washer inbetween them.

14. A grinder according to claim 2, wherein said bayonet end includes a first outer bayonet segment of greater cross-sectional area, and a second inner bayonet segment of smaller cross-sectional area, wherein said first bayonet segment has a cross-sectional shape given by a regular trihedron with three straight and three arc-shaped segments and having an inscribed circle, wherein said second bayonet segment has a cross-sectional shape comprised by three arc-shaped segments having a radius given by said inscribed circle of said trihedron and having a circumferential angle of 60°, three first straight segments, which are aligned with said straight segments of said trihedron and have half their width, and three second straight segments that connect to said first straight segments at 120° and being of the same width as given by the width of said straight segments of said trihedron, and wherein said bayonet opening of said attachment collet has a cross-sectional shape that essentially conforms to said cross-sectional shape of said first bayonet segment.

15. A grinder according to claim 2, wherein said bayonet end contacts said bayonet opening without pitch, by means of radial end surfaces.

16. A grinder according to claim 2, wherein said bayonet end is provided with an extension and said attachment collet is provided with an external opening, and wherein said bayonet end engages positively with said bayonet opening when said bayonet end engages said bayonet opening of said attachment collet.

* * * * *